US007717835B2

(12) United States Patent
Harding-Randle

(10) Patent No.: US 7,717,835 B2
(45) Date of Patent: May 18, 2010

(54) GYNECOLOGY EXERCISE DEVICE

(76) Inventor: Andrea Harding-Randle, 3355 Academy Blvd., Suite 186, Colorado Springs, CO (US) 80917

( * ) Notice: Subject to any disclaimer, the term of this patent is extended or adjusted under 35 U.S.C. 154(b) by 0 days.

(21) Appl. No.: 12/217,354

(22) Filed: Jul. 2, 2008

(65) Prior Publication Data

US 2010/0004102 A1 Jan. 7, 2010

(51) Int. Cl.
*A63B 21/045* (2006.01)
*A63B 23/00* (2006.01)

(52) U.S. Cl. ..... 482/127; 482/148

(58) Field of Classification Search ..... 482/44, 482/49, 127, 10–11, 128, 148
See application file for complete search history.

(56) References Cited

U.S. PATENT DOCUMENTS 770,336 A * 9/1904 Terry ..... 482/49
2,926,911 A * 3/1960 Reichel ..... 482/49
4,262,898 A * 4/1981 Lee ..... 482/49
4,749,186 A * 6/1988 Harding-Randle ..... 482/124
6,758,796 B2 * 7/2004 Stein ..... 482/148
7,077,787 B1 * 7/2006 Wiesman ..... 482/49
2002/0147082 A1 * 10/2002 Harding-Randle ..... 482/128
2005/0233878 A1 * 10/2005 Wen ..... 482/127
2007/0167288 A1 * 7/2007 Lin ..... 482/49

* cited by examiner

*Primary Examiner*—Fenn C Mathew
(74) *Attorney, Agent, or Firm*—Risto A. Rinne, Jr.

(57) ABSTRACT

An apparatus for the strengthening and rebuilding of the muscles of the pelvic floor includes a center generally flat main resistance spring that includes a generally U-shape. The main resistance spring supplies a force which urges separation between a first end and an opposite second end of the main resistance spring. A surrounding case provides a stop mechanism to limit further separation of the first end with respect to the second end. A secondary resistance spring is attached to an interior of the main resistance spring and is used to supply an increase in overall resistance as well as to actuate an optional mechanical counter. An optional pair of auxiliary resistance bands are provided and are urged within a longitudinal channel to vary the magnitude of overall resistance. An optional handle is included to aid in transportation.

16 Claims, 2 Drawing Sheets

GYNECOLOGY EXERCISE DEVICE

This application is related to a previous invention by the same inventor that issued as U.S. Pat. No. 4,749,186 on Jun. 7, 1988.

BACKGROUND OF THE INVENTION

1. Field of the Invention

The present invention, in general, relates to exercise devices and, more particularly, to a gynecology exercise device.

The specification of prior U.S. Pat. No. 4,749,186 by inventor Andrea Harding-Randle that issued on Jun. 7, 1988 is herein incorporated by reference.

The above-identified patent discusses the need for effectively restoring the muscles of the pelvic floor of a patient by the use of an externally-disposed exercise device and discloses a structure that is suitable for such a purpose.

Remediation of the detrimental effects of weakening or damage to the muscles of the pelvic floor, such as thinning out and stretching of the muscles due to childbirth, tear or episiotomy and the resultant decline in the ability to maintain proper tension and closure of the any of the three openings (urethra, vagina, anus) present both practical problems of leakage (i.e., urinary stress incontinence) as well as psychological problems to women.

Weakening or damage to the muscles of the pelvic floor also can contribute to a decline in sexual satisfaction and therefore adversely affect intimacy between couples. Therefore, the quality of the muscles of the pelvic floor include both physical and psychological impacts to the patient.

While the above-described prior art device is useful there remain important unsolved needs for women who wish to improve the tone of the muscles of the pelvic floor area.

For example, there exists a long-standing need for a more simplified construction that incorporates one solid spring instead of two individual wings that are welded to a frame structure. This has not been possible to accomplish heretobefore because of an inability to adjust the tension (i.e., the resistance level) and also because of an inability to control (limit) the opening size in both a safe and aesthetically pleasing manner.

There is also a long-standing need to be able to more easily transport the exercise device from one location to another.

Similarly, users want to know how many repetitions that they have done at each usage.

Also, there exists a long-standing need to easily be able to adjust the resistance to accommodate varying levels of ability. It is important to be able to provide a minimal resistance to those just starting to use the device who have substantially weakened or damaged muscles of the pelvic floor. This is necessary to ensure that further tearing or damage does not occur during exercise. After muscle tone has improved, it is desirable to easily be able to increase the resistance so that maximum toning can occur to the affected muscle groups.

There is also a need to be able to provide a gynecology exercise device that can fit the anatomical size of a greater number of women.

Additionally, if such a device could be used to exercise other muscle groups its utility would be proportionately increased.

Accordingly, there exists today a need for a gynecology exercise device that helps to ameliorate the above-mentioned problems and difficulties as well as ameliorate those additional problems and difficulties as may be recited in the "OBJECTS AND SUMMARY OF THE INVENTION" or discussed elsewhere in the specification or which may otherwise exist or occur and are not specifically mentioned herein.

Clearly, such an apparatus would be a useful and desirable device.

2. Description of Prior Art

Exercise devices are, in general, known.

Devices for exercising and improving the muscles of the pelvic floor that are internally inserted into the vagina are known and have severe limitations inherent in their use including issues of hygiene and convenience of use.

The following patent describes an externally disposed device useful in helping to rebuild the muscles of the pelvic floor:

U.S. Pat. No. 4,749,186 to Andrea Harding-Randle that issued on Jun. 7, 1988.

While the structural arrangements of the above described devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a gynecology exercise device that is easy to manufacture.

It is also an important object of the invention to provide a gynecology exercise device that is durable.

Another object of the invention is to provide a gynecology exercise device that is adjustable in the amount of resistance to movement of a portion thereof that is experienced by a user.

Still another object of the invention is to provide a gynecology exercise device that is useful in rebuilding or strengthening the muscles of the pelvic floor area.

Still yet another object of the invention is to provide a gynecology exercise device that is able to keep track of the number of repetitions that have been accomplished.

Yet another important object of the invention is to provide a gynecology exercise device that is suitable for use by a majority of women having a significant variance in body size.

Still yet another important object of the invention is to provide a gynecology exercise device that includes a solid one-piece main resistance spring at its core.

A first continuing object of the invention is to provide a gynecology exercise device that can be used by women.

A second continuing object of the invention is to provide a gynecology exercise device that includes a carrying handle.

A third continuing object of the invention is to provide a gynecology exercise device that includes means to prevent a one-piece spring from opening an excessive amount during use.

A fourth continuing object of the invention is to provide a gynecology exercise device that does not include sharp or exposed edges that could snag on clothing that is worn by a user or which might injure the user.

A fifth continuing object of the invention is to provide a gynecology exercise device that can be used in varying positions to exercise additional muscles that are not part of those associated with the pelvic floor.

A sixth continuing object of the invention is to provide a gynecology exercise device that includes one or more auxiliary resistance bands that are used to vary an amount of resistance to motion that is experienced during use of the device.

A seventh continuing object of the invention is to provide a gynecology exercise device that includes a channel and an auxiliary resistance band disposed in the channel and wherein the auxiliary resistance band can be moved along a longitudinal length of the channel to vary an overall resistance level.

A seventh continuing object of the invention is to provide a gynecology exercise device that includes a channel and two or more auxiliary resistance bands disposed in the channel and wherein each of the two or more auxiliary bands can be moved along the longitudinal length of the channel to vary an overall resistance level.

Briefly, a gynecology exercise device that is constructed in accordance with the principles of the present invention has a main resistance spring that extends in a generally U-shape. The main resistance spring supplies a force that tends to further increase the distance between a first main spring end and an opposite second main spring end of the main resistance spring. A stop mechanism built into a surrounding case limits further separation of the first main spring end with respect to the second main spring end. Auxiliary resistance bands disposed in a channel along a center longitudinal axis of the device are urged along a longitudinal length of the channel and are used to vary an overall resistance level provided by the device. Various exercises can be performed by the device and are used to strengthen the pelvic floor as well as to strengthen other muscle groups of the body. A handle is preferably included to aid in transportation. A repetition counter is preferably included to provide an indication of the number of repetitive exercise cycles performed.

DETAILED DESCRIPTION OF THE INVENTION

Figure 1:
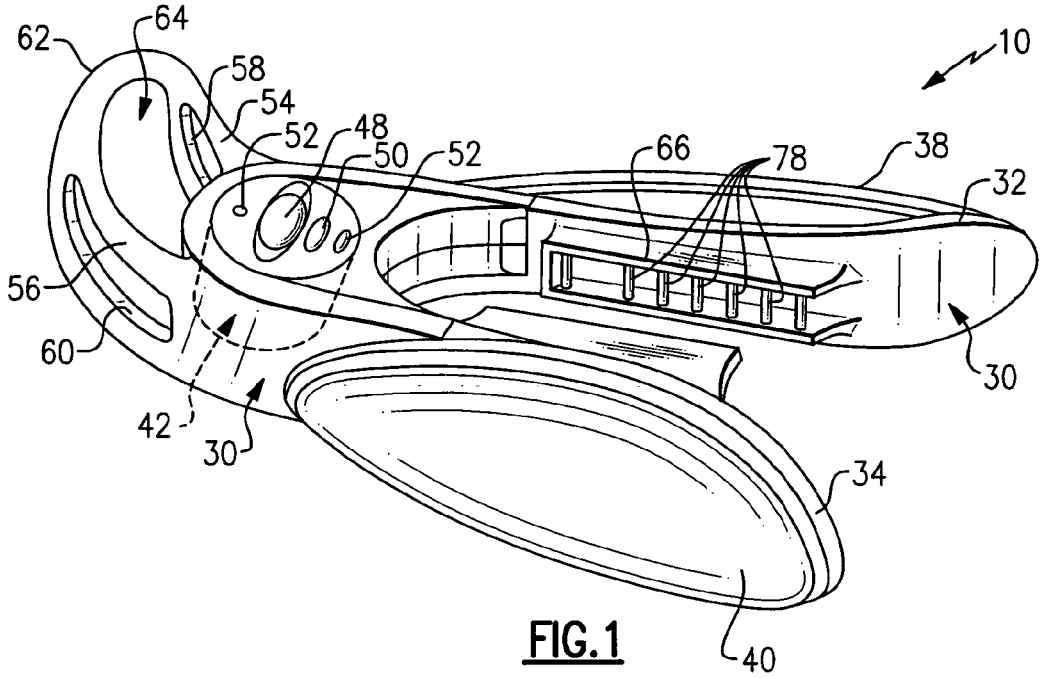
FIG. 1 is a view in perspective of a gynecology exercise device, absent a pair of auxiliary resistance bands for improved clarity of construction.

Referring primarily to FIG. 1 and on occasion to all of the drawing figures is shown, a gynecology exercise device, identified in general by the reference numeral 10.

Inside of the gynecology exercise device 10 and extending along its longitudinal length is found a main resistance spring 12 (FIGS. 4 and 5) that is formed of flat-stock of spring steel. A first portion of the main resistance spring 12, as identified by bracket 14 includes a height dimension of approximately 2 inches. A second portion as identified by bracket 16 of the main resistance spring 12 includes a height dimension of approximately 2.5 inches. The first portion 14 and the second portion 16 are on each of two opposite sides of the gynecology exercise device 10.

A small upper taper 18 and a small lower taper 20 accommodates the change in height between the first portion 14 and the second portion 16. The small upper taper 18 and the small lower taper 20 occur in mirror-like manner on opposite sides of the main resistance spring 12. A preferred thickness for the main resistance spring 12 is approximately 0.62 inches, although this and all dimensions are subject to variance, as desired.

The second portion 16 of the main resistance spring 12 includes a generally U-shape. The first portion 14 of the main resistance spring 12 is slightly arcuate with an outward flare along its longitudinal length.

The main resistance spring 12 provides a significant portion of the overall resistance that is experienced when using the gynecology exercise device 10, as is described in greater detail hereinafter.

A pair of opposite ends 22*a*, 22*b* of a smaller generally U-shaped secondary resistance spring 22 are attached by rivets 24 or by any preferred fastener or method to an inside of the main resistance spring 12 proximate the upper taper 18 and the lower taper 20 on both sides of the main resistance spring 12.

The main resistance spring 12 and the secondary resistance spring 22 supply a force that tends to urge a first main spring end 12*a* apart from a second main spring end 12*b*, in a direction as is generally shown by arrows 26 and 28, respectively.

Figure 4:
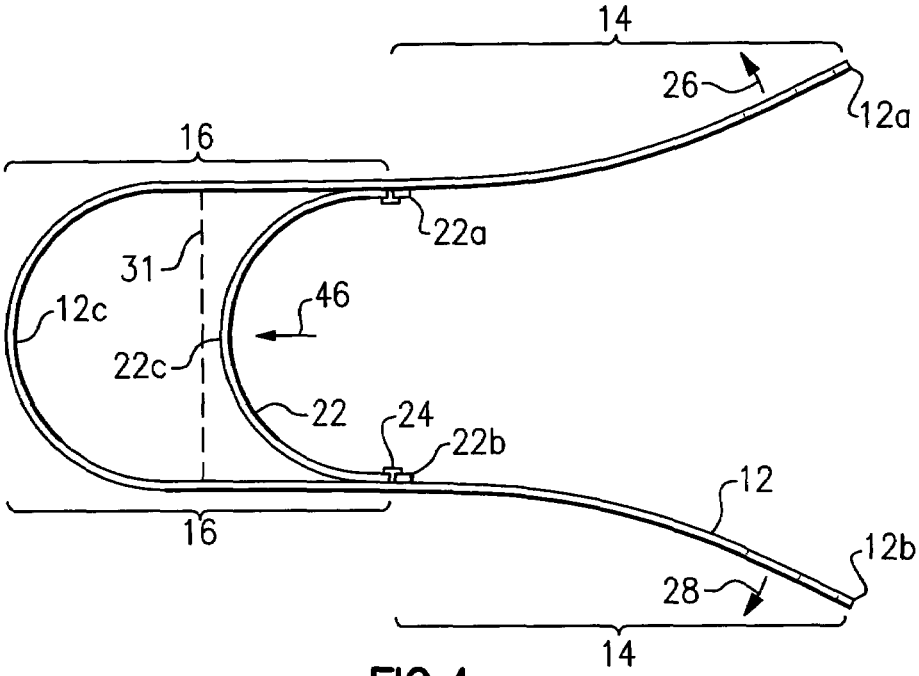
FIG. 4 is a top view of a spring assembly of the gynecology exercise device of FIG. 1.
Figure 5:
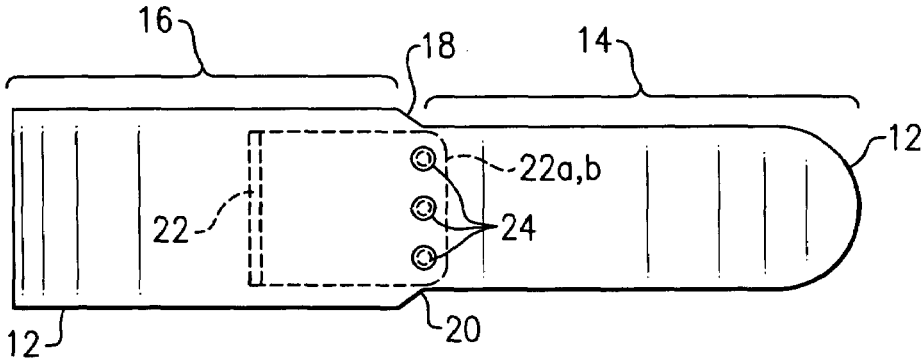
FIG. 5 is a side view of the spring assembly of FIG. 4.

The first main spring end 12*a* and the second main spring end 12*b* preferably supply a force that is tending to urge the first main spring end 12*a* and the second main spring end 12*b* to separate further apart from each other than is shown in FIG. 1 or FIG. 4.

Figure 2:
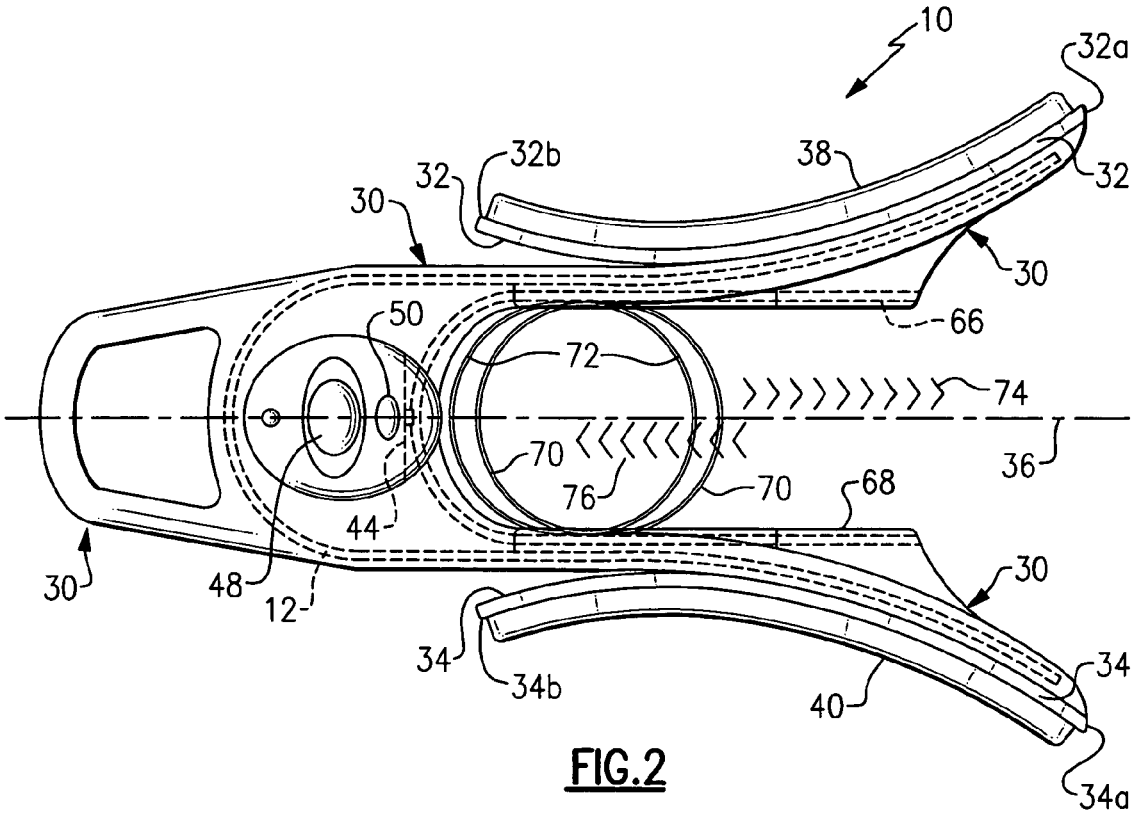
FIG. 2 is a top view of the gynecology exercise device of FIG. 1 with the two auxiliary resistance bands in their respective tracks.
Figure 3:
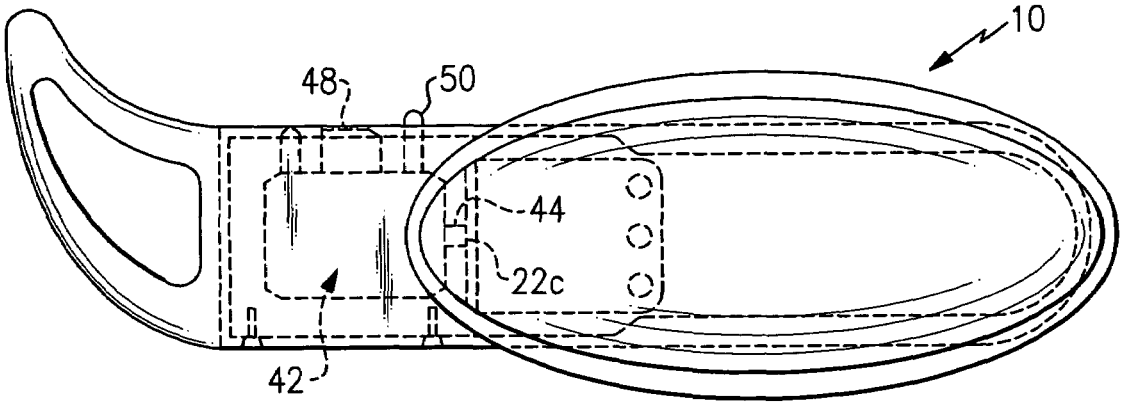
FIG. 3 is a side view in perspective of the gynecology exercise device of FIG. 1.

However, the distance that the first main spring end 12*a* and the second main spring end 12*b* can separate apart from each other (as shown by arrows 26 and 28) is limited by a plastic case, identified in general by the reference numeral 30 (FIGS. 1 and 2). A forward portion of the case 30 preferably extends across a top and bottom of the gynecology exercise device 10 and it also overlaps the sides of the main resistance spring 12 on an exterior of the gynecology exercise device 10.

A portion of the case 30 is used to limit outward motion of the first main spring end 12*a* away from the second main spring end 12*b*. This portion includes a rigid material for use in the case 30 that extends, generally, up to a location that is proximate the upper taper 18 and the lower taper 20 on both sides of the gynecology exercise device 10.

The overlap of this portion of the case 30 limits and thereby prevents a further opening of the first main spring end 12*a* and the second main spring end 12*b* by the main resistance spring 12. Other ways of limiting separation are also possible, for example, by the use of a flexible but not overly stretchable strap 31 (dashed line FIG. 4), such as would be provided by the use of a metallic cable that extends across and which was attached at any desired location to the main resistance spring 12 and preferably along the forward portion of the main resistance spring 12, as defined by bracket 16 (i.e., the second portion of the main resistance spring 12).

A rearward portion of the case 30 (see FIG. 2) corresponds generally with an area of the main resistance spring 12 as identified by bracket 14 (i.e., the first portion of the main resistance spring 12) and is especially flexible. A softer plastic or vinyl or other type of material or a combination of materials is used to form the overall case 30. The rearward portion of the case 30 surrounds the main resistance spring 12, which is shown disposed in the case 30 by dashed lines in FIG. 2.

The rearward portion of the case 30 includes a first outer arcuate member 32 and an oppositely disposed second outer arcuate member 34 that are disposed on an outside of the case 30, facing generally away from each other. The first outer arcuate member 32 and the second outer arcuate member 34 are either molded, and thereby included as an integral part of the rearward portion of the case 30, or they are attached to the case 30 by any preferred method.

The first outer arcuate member 32 and the second outer arcuate member 34 extend along the longitudinal length of the rearward portion of the case 30 and include a generally concave curvature. A geometric center of the first outer arcuate member 32 and a center of the second outer arcuate member 34 are disposed maximally close to a center longitudinal axis 36 (dashed line, FIG. 2) that passes through a center of the gynecology exercise device 10. A pair of opposite ends 32*a*, 32*b* of the first outer arcuate member 32 and a pair of opposite ends 34*a*, 34*b* of the second outer arcuate member 34 are disposed generally further away from the center longitudinal axis 36 than are the geometric centers of the first and second outer arcuate members 32, 34.

A first cushion pad 38 is attached to the first outer arcuate member 32 and a second cushion pad 40 is attached to the second outer arcuate member 34. The first and second cushion pads 38, 40 engage with various body parts of the user during use of the gynecology exercise device 10 for any exercise that is to be performed. For all exercises performed, the user supplies a periodic, repetitive force that urges the first cushion pad 38 and the second cushion pad 40 simultaneously in a direction toward each other, opposite to that as shown by arrows 26 and 28 (FIG. 4).

It is important to understand that for any exercise performed, the first cushion pad 38 and the second cushion pad 40 are urged toward each other a predetermined amount that can vary from person to person or from exercise to exercise and to complete the cycle the first cushion pad 38 and the second cushion pad 40 are then released back into a quiescent or extended state, as shown by FIGS. 1 and 2. This is accomplished by a muscle contraction and release of a desired muscle or muscle group by the user.

Each compression and subsequent release of the first cushion pad 38 and the second cushion pad 40, together, constitute one repetition, or one cycle, of the gynecology exercise device 10, regardless of the magnitude (i.e., the distance) of inward motion by the first cushion pad 38 and the second cushion pad 40 that occurs.

It is desirable to be able to keep track of the number of repetitions accomplished for any given exercise that is preformed by the gynecology exercise device 10 and to reset the number and begin from zero for each particular exercise. It is also desirable to not rely upon an electronic type of counting device (not shown) that needs periodic battery replacements, although such a device could be used with the gynecology exercise device 10, if desired.

This is accomplished by the use of a mechanically actuated counter, identified in general by the reference numeral 42, that can be mechanically reset to zero and which incrementally counts upward from zero for every compression and release of a counting member 44 (FIG. 2) of the counter 42 that occurs. This is described in greater detail hereinafter.

The counter 42 is secured to the case 30 and is disposed within a forward opening provided in the case 30 immediately forward of and adjacent to a center point 22*c* (see FIG. 4) of the secondary resistance spring 22. The forward opening in the case 30 extends along the longitudinal axis 36 from the center point of the secondary resistance spring 22 to a center point 12*c* of the main resistance spring 12 and across the width of the case 30 up until contact with the opposite sides of the main resistance spring 12 occurs.

If the strap 31 is used to limit outward motion of the main resistance spring 12, the strap 31 is raised or lowered so that it does not cause interference with the counter 42.

It is to be noted that the counting member 44 is disposed adjacent to the center point 22*c* of the secondary resistance spring 22. For every cycle of the gynecology exercise device 10 beginning with the inward movement of the first and second cushion pads 38, 40, the secondary resistance spring 22 is also compressed. Because the opposite ends 22*a*, 22*b* of the secondary resistance spring 22 are fixedly attached to the main resistance spring 12, any amount of compression of the secondary resistance spring 22 will immediately urge the center point 22*c* of the secondary resistance spring 22 in a direction as shown by arrow 46 (FIG. 2).

The motion of the center point 22*c* of the secondary resistance spring 22 in the direction of arrow 46 compresses the counting member 44 which, in turn, increments a mechanical digit display 48. The digits of the mechanical digit display 48 are visible through either an opening or through a clear covering that is provided in the case 30 and which is disposed over the digit display 48 of the counter 42. This allows the user to monitor the number of repetitions (cycles) that occur during exercise.

A relaxation by the user of the force applied to the first and second cushions 38, 40 allows expansion of the main resistance spring 12 and of the secondary resistance spring 22 to occur until they are again disposed in the expanded, quiescent position. The center point 22*c* of the secondary resistance spring 22 is accordingly urged in a direction opposite to that as shown by arrow 46. A spring in the counter 42 urges the counting member 44 outward so that it stays adjacent to, and thereby tracks, the movement experienced by the center point 22*c* of the secondary resistance spring 22 either in the direction of arrow 46 or in the opposite direction of arrow 46. In this manner, the counter 42 is made ready to repeat the process and to increment the digit display 48 for each cycle of the gynecology exercise device 10.

A reset button 50 is disposed so that it is accessible for depression from an exterior of the case 30. When the resent button 50 is depressed and released, the digit display 48 is reset to zero. The counter 42 is secured to the case 30 by any preferred means. If desired, screws 52 or other fasteners may be used to secure the counter 42 to the case 30.

A forward portion of the case 30 extends along the longitudinal axis 36 in a forward direction and includes a pair of first and second oppositely disposed sides 54, 56 that are generally parallel with the longitudinal axis 36. If desired, for decorative or mechanical reasons, a first side opening 58 may be included in the first side 54 and a similar second side opening 60 may be included in the second side 56.

An arcuate member 62 extends in a curvature from the first side 54 to the second side 56 and provides a carrying handle for easy transport of the gynecology exercise device 10. A handle opening, identified in general by the reference numeral 64, is provided between the first and second sides 54, 56 and the arcuate member 62 into which the fingers of the user may be placed during carrying of the gynecology exercise device 10.

A first longitudinal channel 66 (FIGS. 1 and 2) is disposed along an interior of the case 30 on the side of the gynecology exercise device 10 where the first cushion 38 is disposed. The first longitudinal channel 66 extends along a portion of the length of first portion 14 of the main resistance spring 12.

An oppositely disposed second longitudinal channel 68 (FIG. 2) is a mirror-image of the first longitudinal channel 66 and is disposed along an interior of the case 30 on the side of the gynecology exercise device 10 where the second cushion 40 is disposed. The second longitudinal channel 68 extends along a portion of the length of first portion 14 of the main resistance spring 12 an amount that is equal to that of the first longitudinal channel 66.

When the gynecology exercise device 10 is disposed in the quiescent state, the first longitudinal channel 66 and the second longitudinal channel 68 are both generally parallel with respect to each other and also with respect to the center longitudinal axis 36.

An upper auxiliary resistance band 70 is disposed in an upper portion of both the first and the second longitudinal channels 66, 68 (see FIG. 2). A lower auxiliary resistance band 72 is disposed in a lower portion of both the first and the second longitudinal channels 66, 68, and under the upper auxiliary resistance band 70.

The upper auxiliary resistance band 70 and the lower auxiliary resistance band 72 are approximately the same size and generally form a somewhat circular shape when the gynecology exercise device 10 is in the quiescent state. It is also possible that when the upper auxiliary resistance band 70 and the lower auxiliary resistance band 72 are disposed in the first and the second longitudinal channels 66, 68 (as shown in FIG. 2) they may be slightly compressed even when the gynecology exercise device 10 is disposed in the quiescent state and, therefore, they may assume a slightly oval shape.

When the first and second cushions 38, 40 are urged toward each other during use of the gynecology exercise device 10, the upper auxiliary resistance band 70 and the lower auxiliary resistance band 72 are further compressed and tend to assume a somewhat more oval shape during such usage.

Either the upper auxiliary resistance band 70 or the lower auxiliary resistance band 72 can be independently urged in the direction of arrows 74 to provide a higher overall resistance setting or in the direction of arrows 76 to provide a lower overall resistance setting. If desired, both the upper auxiliary resistance band 70 and the lower auxiliary resistance band 72 can be moved together in the same direction, for example, either in the direction of arrows 74 for an even greater overall resistance or in the direction of arrows 76 for a more minimal overall resistance.

It is, of course, possible to urge either one of the upper auxiliary resistance band 70 or the lower auxiliary resistance band 72 in the direction of either arrows 74 or arrows 76 and to urge the remaining one in the opposite direction.

The overall resistance that is experienced when attempting to urge the first and second cushions 38, 40 together includes the resistance provided by the main resistance spring 12, combined with resistance provided by the secondary resistance spring 22, further combined with the resistance provided by the upper auxiliary resistance band 70 and the lower auxiliary resistance band 72 taking into account, also, the position of the upper auxiliary resistance band 70 and the position of the lower auxiliary resistance band 72 as they are disposed within the longitudinal length of the first and the second longitudinal channels 66, 68.

If either the upper auxiliary resistance band 70 or the lower auxiliary resistance band 72 are urged in the direction of arrows 74, the higher overall resistance is provided because more compression of the upper auxiliary resistance band 70 or the lower auxiliary resistance band 72 will occur for any given amount of compression of the gynecology exercise device 10 than if either the upper auxiliary resistance band 70 or the lower auxiliary resistance band 72 are urged in the direction of arrows 76.

The higher resistance settings of the upper auxiliary resistance band 70 or the lower auxiliary resistance band 72 are generally increasingly used as the muscle tone of user progressively improves. Conversely, the lower resistance settings of the upper auxiliary resistance band 70 or the lower auxiliary resistance band 72 are generally used for users with weaker muscle tone or when recovering from an injury or surgery.

Disposed within each of the first and the second longitudinal channels 66, 68 are included a series of spaced-apart vertical protruding bars 78. The vertical protruding bars 78 in the first and the second longitudinal channels 66, 68 mirror each other in shape and position and are used to retain the upper auxiliary resistance band 70 and the lower auxiliary resistance band 72 in any position within the upper or lower portions of the first and the second longitudinal channels 66, 68 that they are each individually urged into.

As the upper auxiliary resistance band 70 and the lower auxiliary resistance band 72 are each urged along the longitudinal length of the first and the second longitudinal channels 66, 68, they must compress an additional amount in order to pass over the vertical protruding bars 78 which protrude above a bottom surface of the first and the second longitudinal channels 66, 68. This additional compression provides increased resistance to the longitudinal movement by either the upper auxiliary resistance band 70 or the lower auxiliary resistance band 72 which helps to retain them in the position that they have been urged into.

The upper auxiliary resistance band 70 and the lower auxiliary resistance band 72 are formed of spring steel or any preferred material. An advantage to the use of the upper auxiliary resistance band 70 and the lower auxiliary resistance band 72 and disposing them in the first and the second longitudinal channels 66, 68 is that they will not fall out accidentally but can be removed by a deliberate effort sufficient to compress them enough to clear either of the first and the second longitudinal channels 66, 68.

A problem with prior art types of exercise equipment is that additional devices used to vary the overall resistance can become separated from the equipment and possibly lost. The gynecology exercise device 10 prevents this from happening while providing both ease and speed of adjustment in varying the overall resistance level. The improved (over prior art) speed and ease of adjustment is accomplished by quickly urging either the upper auxiliary resistance band 70 or the lower auxiliary resistance band 72, or both, in any desired direction within the first and the second longitudinal channels 66, 68.

Also, the use of two auxiliary bands (i.e., the upper auxiliary resistance band 70 and the lower auxiliary resistance band 72) provide a number of possible combinations of resistance to create many combinations of the overall resistance provided by the gynecology exercise device 10. It is possible to only use one auxiliary resistance band (either 70 or 72) as it is possible to use more than two such auxiliary bands, if desired.

A first exercise is to use the gynecology exercise device 10 similar to that as when using the invention as shown in U.S. Pat. No. 4,749,186. Basically, the gynecology exercise device 10 is placed with the arcuate member 62 (i.e., the handle) facing forward about an inch or two below the pelvic floor and pulling it forward. Using the pelvic floor muscles urge the first and second cushions 38, 40 toward each other and then release. Repeat this exercise for the desired number of repetitions after having first adjusted the overall resistance that is provided by the gynecology exercise device 10 in the manner previously described. This exercise embodies a primary purpose of the gynecology exercise device 10 and is used to rebuild or strengthen the muscles in the pelvic floor.

The gynecology exercise device 10 can also be used to rebuild or strengthen other muscles or muscle groups. For example, according to a second exercise it can be placed between the inner thighs with the arcuate member 62 facing downward and, in similar manner, the first and second cushions 38, 40 can be urged toward each other and then released for each exercise repetition.

Similarly, to strengthen the chest and certain arm muscles, the gynecology exercise device 10 can be held in front of the user with the arms raised so that they are parallel to the floor, elbows out, with one of the hands grasping the first cushion 38 and the remaining hand grasping the second cushion 40. The user then urges the cushions 38, 40 toward each other and releases pressure for each exercise repetition.

In a similar manner, the gynecology exercise device 10 can be held over the head of the user with one of the hands grasping the first cushion 38 and the remaining hand grasping the second cushion 40. The user then urges the cushions 38, 40 toward each other and releases pressure for each exercise repetition.

Many other exercises are possible, as well.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A gynecology exercise device, comprising:

(a) a main resistance spring, said main resistance spring including a longitudinal length and wherein said main resistance spring is urged into a general U-shape whereby a first end and an opposite second end are disposed a predetermined distance from each other when said device is in a quiescent state, and wherein said main resistance spring supplies a force that tends to urge said first end away from said second end;

(b) a covering over at least a portion of said main resistance spring;

(c) means for preventing said first end from being urged further than a predetermined distance away from said second end when said device is disposed in said quiescent state;

(d) means for increasing or decreasing an amount of force that is required to urge said first end toward said second end, and wherein said means for increasing or decreasing an amount of force that is required to urge said first end toward said second end includes at least one auxiliary resistance band, and wherein a portion of a first side of said at least one auxiliary resistance band is disposed in a first longitudinal channel and wherein a portion of an opposite second side of said at least one auxiliary resistance band is disposed in a second longitudinal channel and wherein said first longitudinal channel is provided on an inside of a first side of said device and wherein said second longitudinal channel is provided on an inside of an opposite second side of said device; and wherein said main resistance spring is formed of a single piece of material.

2. The gynecology exercise device of claim 1 including a repetition counter attached to said device, wherein said repetition counter provides an indication of the number of times said first end is urged toward said second end so that a distance between said first end and said second end is less than said predetermined distance and then returned to said predetermined distance.

3. The gynecology exercise device of claim 2 wherein said repetition counter is able to be reset to zero after each use.

4. The gynecology exercise device of claim 1 including a case, said case enclosing at least a portion of said device, and wherein said first longitudinal channel is attached to said case and wherein said second longitudinal channel is attached to said case.

5. The gynecology exercise device of claim 1 wherein said at least one auxiliary resistance band includes two or more auxiliary resistance bands, and wherein each of said two or more auxiliary resistance bands are disposed adjacent to each other in said first longitudinal channel and said second longitudinal channel, wherein any of said two or more auxiliary resistance bands can be urged along a longitudinal length of said first longitudinal channel and said second longitudinal channel independent of a remainder of said two or more auxiliary resistance bands.

6. The gynecology exercise device of claim 1 including means for retaining said at least one auxiliary resistance band at a predetermined location along a longitudinal length of said first longitudinal channel and said second longitudinal channel.

7. The gynecology exercise device of claim 1 wherein said means for increasing or decreasing an amount of force that is required to urge said first end toward said second end includes secondary resistance spring that is disposed in said main resistance spring, and wherein said secondary resistance spring includes a generally U-shape and a pair of opposite ends, and wherein each of said pair of opposite ends is attached to said main resistance spring.

8. The gynecology exercise device of claim 1 wherein said means for increasing or decreasing an amount of force that is required to urge said first end toward said second end is detachably-attachable with respect to said device.

9. The gynecology exercise device of claim 1 wherein said means for preventing said first end from being urged further than a predetermined amount away from said second end includes a strap that is attached at one end of said strap to a first half of said main resistance spring and which is attached at an opposite remaining end of said strap to a second half of said main resistance spring.

10. The gynecology exercise device of claim 1 wherein said means for preventing said first end from being urged further than a predetermined amount away from said second end includes a case that extends over a portion of a side of said main resistance spring and wherein said case includes an overlapping portion, and wherein said overlapping portion engages with said main resistance spring sufficient to prevent an opening of said main resistance spring that is greater than said predetermined distance.

11. The gynecology exercise device of claim 1 including a handle attached to said device at a location proximate to a midpoint of said device, said midpoint disposed approximately halfway between said first end and said second end.

12. The gynecology exercise device of claim 1 including a case, and wherein said case encloses at least a portion of said device.

13. The gynecology exercise device of claim 12 wherein said case includes a forward opening that is disposed proximate a center of said main resistance spring, said center of said resistance spring being disposed proximate a midpoint along a longitudinal length of said main resistance spring, and wherein said forward opening includes an area sufficient to receive therein at least a portion of a repetition counter, and wherein said repetition counter includes a digit display, and wherein a numeric value of said digit display increments by one every time said first end of said main resistance spring is urged toward said second end of said main resistance spring and returned again to its starting position.

14. The gynecology exercise device of claim 13 including means for resetting said repetition counter, and wherein said numeric value in said digit display is set to zero when said means for resetting is activated.

15. The gynecology exercise device of claim 12 wherein said case includes a first cushion disposed on an exterior side of said device on a first side of said device and a second cushion disposed on an exterior side of said device on an opposite second side of said device.

16. A gynecology exercise device, comprising:

(a) a main resistance spring, said main resistance spring including a longitudinal length and wherein said main resistance spring is urged into a general U-shape whereby a first end and an opposite second end are disposed a predetermined distance from each other when said device is in a quiescent state, and wherein said main resistance spring supplies a force that tends to urge said first end away from said second end;

(b) a covering over at least a portion of said main resistance spring;

(c) means for preventing said first end from being urged further than a predetermined distance away from said second end when said device is disposed in said quiescent state;

d) a case that encloses at least a portion of said device and wherein said case includes a forward opening that is disposed proximate a center of said main resistance spring, said center of said resistance spring being disposed proximate a midpoint along a longitudinal length of said main resistance spring, and wherein said forward opening includes an area sufficient to receive therein at least a portion of a repetition counter, and wherein said repetition counter includes a digit display, and wherein a numeric value of said digit display increments by one every time said first end of said main resistance spring is urged toward said second end of said main resistance spring and returned again to its starting position; and wherein said main resistance spring is formed of a single piece of material.

* * * * *